US008100165B2

(12) United States Patent
Piggush et al.

(10) Patent No.: US 8,100,165 B2
(45) Date of Patent: Jan. 24, 2012

(54) INVESTMENT CASTING CORES AND METHODS

(75) Inventors: Justin D. Piggush, Hartford, CT (US); Karl A. Mentz, Hartford, CT (US); Richard H. Page, Guilford, CT (US); Jesse R. Christophel, Manchester, CT (US); Ricardo Trindade, Coventry, CT (US)

(73) Assignee: United Technologies Corporation, Hartford, CT (US)

( * ) Notice: Subject to any disclaimer, the term of this patent is extended or adjusted under 35 U.S.C. 154(b) by 404 days.

(21) Appl. No.: 12/271,980

(22) Filed: Nov. 17, 2008

(65) Prior Publication Data

US 2010/0122789 A1 May 20, 2010

(51) Int. Cl.
*B22C 9/10* (2006.01)
*B22C 9/04* (2006.01)
*B22C 7/00* (2006.01)

(52) U.S. Cl. ..... 164/369; 164/28; 164/516; 164/361; 164/45; 164/235

(58) Field of Classification Search ..... 164/369, 164/28, 516, 361, 45, 235
See application file for complete search history.

(56) References Cited

U.S. PATENT DOCUMENTS

| | | | | |
|---|---|---|---|---|
| 3,957,104 | A * | 5/1976 | Terpay | 164/132 |
| 4,542,867 | A | 9/1985 | Memmen | |
| 6,637,500 | B2 * | 10/2003 | Shah et al. | 164/369 |
| 6,929,054 | B2 | 8/2005 | Beals et al. | |
| 7,014,424 | B2 | 3/2006 | Cunha et al. | |
| 7,134,475 | B2 | 11/2006 | Snyder et al. | |
| 7,270,170 | B2 | 9/2007 | Beals et al. | |
| 7,270,173 | B2 | 9/2007 | Wiedemer et al. | |
| 7,413,403 | B2 | 8/2008 | Cunha et al. | |
| 2004/0202542 | A1 * | 10/2004 | Cunha et al. | 416/97 R |
| 2006/0239819 | A1 | 10/2006 | Albert et al. | |
| 2007/0044933 | A1 | 3/2007 | Santeler | |
| 2008/0145235 | A1 | 6/2008 | Cunha et al. | |

FOREIGN PATENT DOCUMENTS

EP 1857199 A1 11/2007

OTHER PUBLICATIONS

European Search Report for EP Patent Application No. 09252636.7, dated Feb. 24, 2010.

* cited by examiner

*Primary Examiner* — Jessica L Ward
*Assistant Examiner* — Jacky Yuen
(74) *Attorney, Agent, or Firm* — Bachman & LaPointe, P.C.

(57) ABSTRACT

An investment casting core combination includes a metallic casting core and a ceramic feedcore. A first region of the metallic casting core is embedded in the ceramic feedcore. A mating edge portion of the metallic casting core includes a number of projections. The first region is along at least some of the projections. A number of recesses span gaps between adjacent projections. The ceramic feedcore includes a number of compartments respectively receiving the metallic casting core projections. The ceramic feedcore further includes a number of portions between the compartments and respectively received in the metallic casting core recesses.

21 Claims, 4 Drawing Sheets

INVESTMENT CASTING CORES AND METHODS

BACKGROUND

The disclosure relates to investment casting. More particularly, it relates to the investment casting of superalloy turbine engine components.

Investment casting is a commonly used technique for forming metallic components having complex geometries, especially hollow components, and is used in the fabrication of superalloy gas turbine engine components. The invention is described in respect to the production of particular superalloy castings, however it is understood that the invention is not so limited.

Gas turbine engines are widely used in aircraft propulsion, electric power generation, and ship propulsion. In gas turbine engine applications, efficiency is a prime objective. Improved gas turbine engine efficiency can be obtained by operating at higher temperatures, however current operating temperatures in the turbine section exceed the melting points of the superalloy materials used in turbine components. Consequently, it is a general practice to provide air cooling. Cooling is provided by flowing relatively cool air from the compressor section of the engine through passages in the turbine components to be cooled. Such cooling comes with an associated cost in engine efficiency. Consequently, there is a strong desire to provide enhanced specific cooling, maximizing the amount of cooling benefit obtained from a given amount of cooling air. This may be obtained by the use of fine, precisely located, cooling passageway sections.

The cooling passageway sections may be cast over casting cores. Ceramic casting cores may be formed by molding a mixture of ceramic powder and binder material by injecting the mixture into hardened steel dies. After removal from the dies, the green cores are thermally post-processed to remove the binder and fired to sinter the ceramic powder together. The trend toward finer cooling features has taxed core manufacturing techniques. The fine features may be difficult to manufacture and/or, once manufactured, may prove fragile. Commonly-assigned U.S. Pat. No. 6,637,500 of Shah et al., U.S. Pat. No. 6,929,054 of Beals et al., U.S. Pat. No. 7,014,424 of Cunha et al., U.S. Pat. No. 7,134,475 of Snyder et al., and U.S. Patent Publication No. 20060239819 of Albert et al. (the disclosures of which are incorporated by reference herein as if set forth at length) disclose use of ceramic and refractory metal core combinations.

SUMMARY

One aspect of the disclosure involves an investment casting core combination. The combination includes a metallic casting core and a ceramic feedcore. A first region of the metallic casting core is embedded in the ceramic feedcore. A mating edge portion of the metallic casting core includes a number of projections. The first region is along at least some of the projections. A number of recesses span gaps between adjacent projections. The ceramic feedcore includes a number of compartments respectively receiving the metallic casting core projections. The ceramic feedcore further includes a number of portions between the compartments and respectively received in the metallic casting core recesses.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
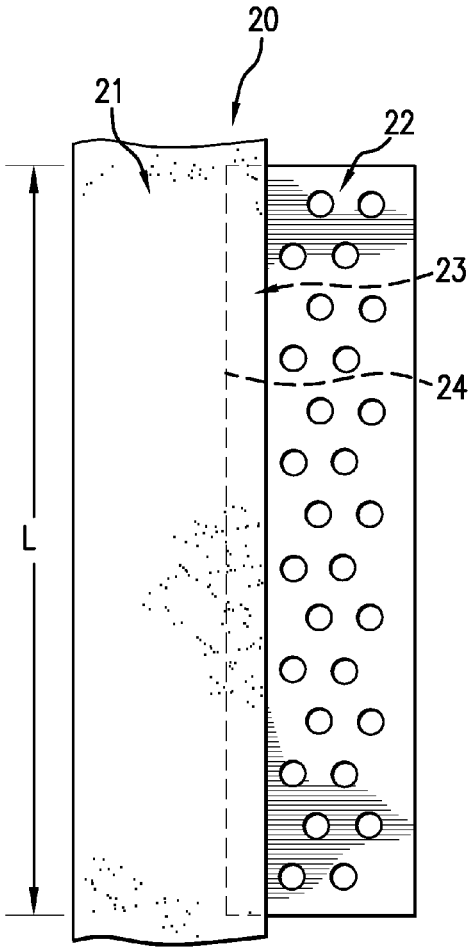
FIG. 1 PRIOR ART
FIG. 1 is a partially schematic side view of a prior art core assembly.

FIG. 1 shows an exemplary core assembly 20 including a ceramic feedcore 21 and an RMC 22. The exemplary assembly is illustrative of a feedcore forming a trailing edge slot for a blade or vane airfoil. A joint 23 is formed by a leading region of the exemplary RMC 22 mounted in a trailing slot 24 in the feedcore 21. The joint 23 may further include a filler material (such as a hardened ceramic adhesive or slurry) at one or more locations between the RMC 22 and the ceramic feedcore 21. The joint 23 has a length L.

Figure 2:
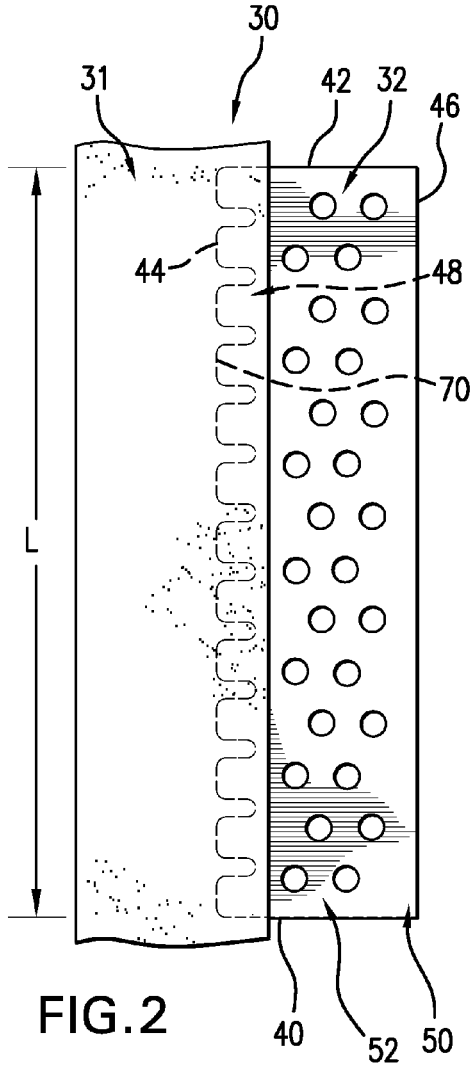
FIG. 2 is a partially schematic side view of a revised core assembly.
Figure 3:
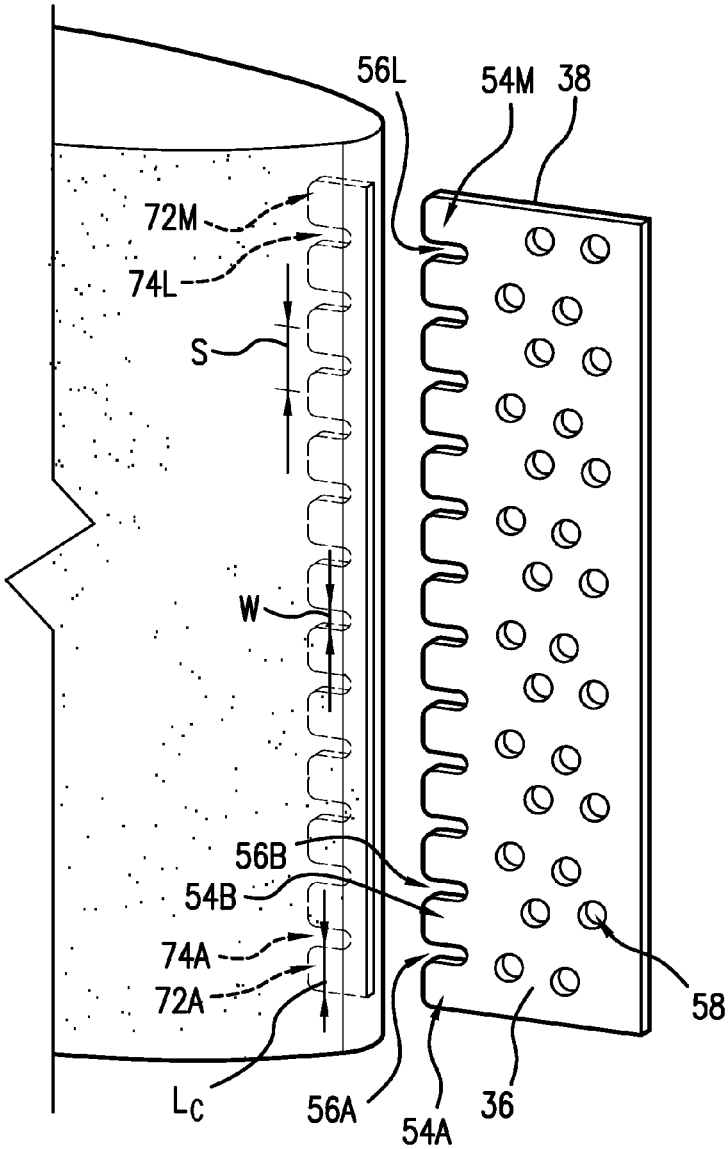
FIG. 3 is an exploded view of the revised core assembly of FIG. 2.

A modified feedcore/RMC assembly 30 is shown in FIGS. 2 and 3. The modified ceramic feedcore 31 may be formed by molding (e.g., as in the prior art). The modified RMC 32 may be formed from sheetstock and have first and second faces 36 and 38 (FIG. 3) for forming an exemplary trailing edge discharge slot. The exemplary RMC 32 has first and second span-wise ends/edges (e.g., an inboard end 40 and an outboard end 42) and first and second streamwise ends/edges (e.g., a leading edge 44 and a trailing edge 46).

As with the exemplary baseline core, a region 48 of the RMC (e.g., a portion near the leading end/edge 44) may be received by the feedcore. A region 50 (e.g., near the trailing end/edge 46) may be received in the pattern forming die and, ultimately, in the shell so as to cast one or more openings in the surface of the casting. A main portion 52 of the RMC may cast the ultimate discharge slot.

The region 48 comprises a plurality of projections (tabs/tongues) 54A-54M separated from each other by recesses 56A-56L. The exemplary projections are unitarily formed with the main portion 52 by removing adjacent material from the refractory metal sheetstock. The removal may be part of the same process that forms additional holes/apertures 58 in the RMC main portion 52 (e.g., for casting posts in the ultimate discharge slot). The exemplary apertures 58 are internal through-apertures. They are "internal" or "closed" in that they are not open to the lateral perimeters of the islands (e.g., along the leading and trailing edges, the inboard and outboard edges, or along the gaps). The RMC's mating region 48 is received in a trailing region 70 of the feedcore. The exemplary trailing region (receiving region) 70 comprises a subdivided compartment having individual recesses or compartments 72A-72M at least partially separated from adjacent ones of each other by dividing walls 74A-74L.

Figure 4:
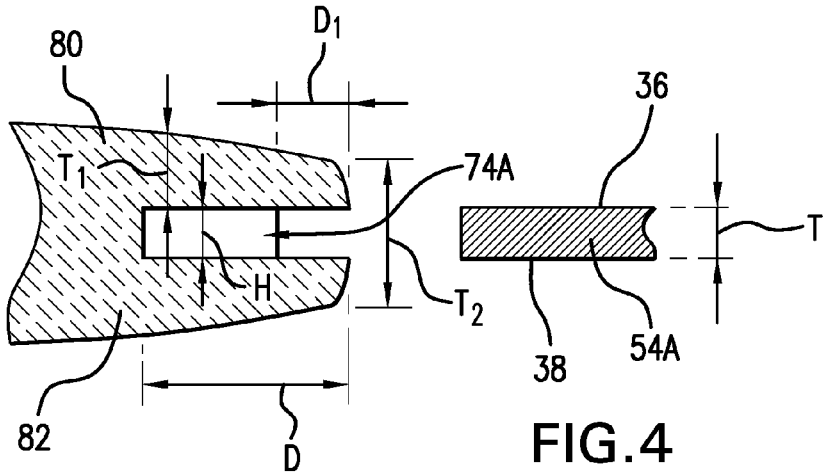
FIG. 4 is an enlarged exploded sectional view of a joint of the assembly of FIG. 3.

FIG. 4 shows each recess 72A-72M as having a height (or height profile) H and a depth D. FIG. 3 shows each compartment 72A-72M as having a spanwise length or depth-dependent length profile $L_C$. The exemplary embodiment merges the compartments 72A-72M along the small initial portion $D_1$ (FIG. 4) of the total depth. Exemplary $D_1$ is less than 50% of D (e.g., measured as an appropriate average such as a mean or median value), more narrowly, 5-20% of D. Exemplary $L_C$ is 1.5-10 mm measured as such an average. A length of the projections 54A-54M may be similar.

FIG. 4 further shows an RMC thickness T between the faces 36 and 38. Exemplary T may be measured including any pre-applied coating. In one example, T is 0.2-0.5 mm, more broadly 0.2-1.0 mm. Exemplary peak depth of the recesses 56A-56L is 300-500% of T. An exemplary thickness T is 50-100% of H (e.g., measured as an appropriate average such as a mean or median value). FIG. 4 further shows portions 80 and 82 of the feedcore on either side of the trailing region 70. A depth-dependent thickness profile of these portions is shown as $T_1$ which may be different for each of the two.

An exemplary feedcore thickness $T_2$ at its trailing edge (H at the trailing edge plus $T_1$ for each side at the trailing edge) is 300-700% of H. Exemplary $D_1$ is 100-200% of H. Exemplary on-center spacing or pitch S of the projections and recesses is at least 400% of H and may be effective to provide at least three projections and recesses. An exemplary characteristic wall width or span W (e.g., measured as a mean or median) is at least 200% of H and is less than 85% of S (e.g., 25-50% of S). Exemplary depth D is 300-800% of H. An exemplary $L_c$ (e.g., median) may be 50-800% of D (e.g., median) along a majority of a total depth of the recesses 72A-72M.

Relative to a single slot of uniform depth, the divided compartment provides a more distributed support to the regions 80 and 82. Accordingly, it may provide greater flexibility in providing particularly small thicknesses $T_1$ and $T_2$.

Figure 5:
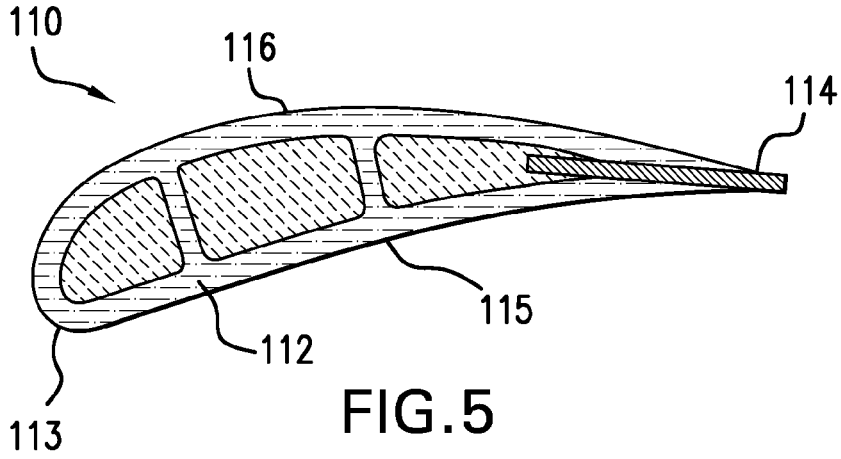
FIG. 5 is a sectional view of an investment casting pattern.

FIG. 5 shows a pattern 110 formed by the molding of wax over the core assembly. The wax includes an airfoil portion 112 extending between a leading edge 113 and a trailing edge 114 and having a pressure side 115 and a suction side 116. The pattern may further include portions for forming an outboard shroud and/or an inboard platform (not shown).

Figure 6:
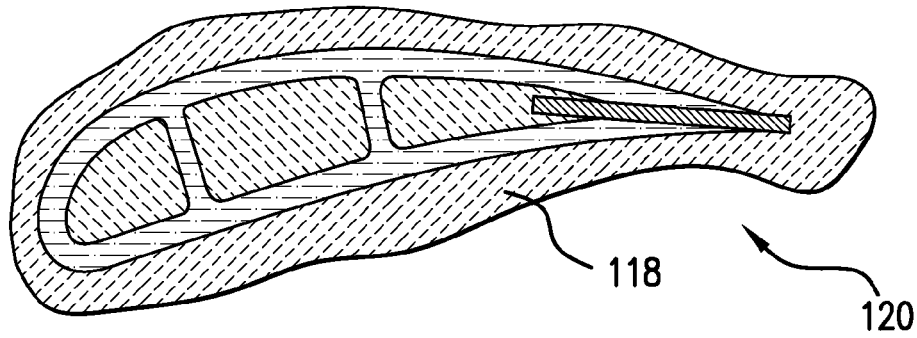
FIG. 6 is a sectional view of a shell formed over the pattern of FIG. 5.

FIG. 6 is a sectional view showing the pattern airfoil after shelling with stucco 118 to form the shell 120.

Figure 7:
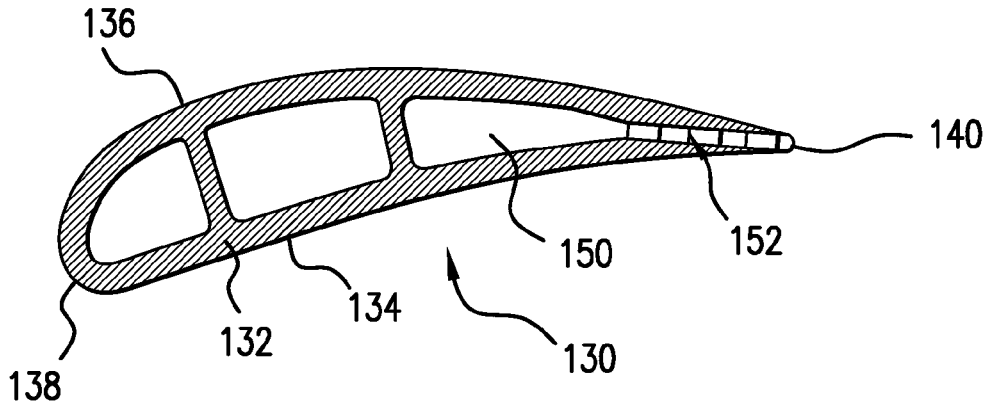
FIG. 7 is a sectional view of a casting cast by the shell of FIG. 6.

FIG. 7 shows the resulting casting 130 after deshelling and decoring. The casting has an airfoil 132 having a pressure side 134 and a suction side 136 and extending from a leading edge 138 to a trailing edge 140. The ceramic feedcore 21 casts one or more feed passageways 150 and the RMC casts a discharge outlet slot 152.

Figure 8:
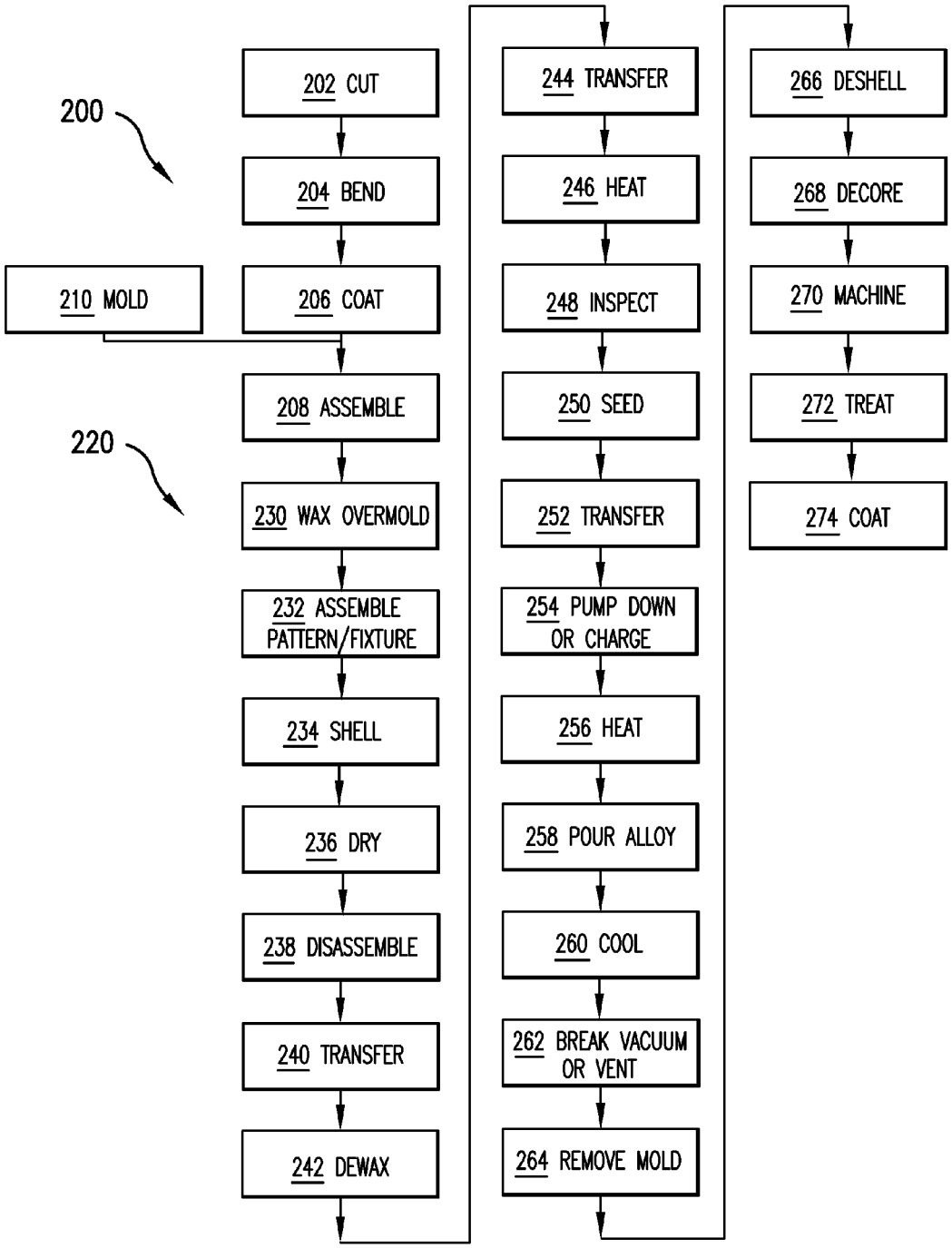
FIG. 8 is a flowchart of a core manufacturing process.

Steps in the manufacture 200 of the core assembly are broadly identified in the flowchart of FIG. 8. In a cutting operation 202 (e.g., laser cutting, electro-discharge machining (EDM), liquid jet machining, or stamping), a cutting is cut from a blank. The exemplary blank is of a refractory metal-based sheet stock (e.g., molybdenum or niobium) having the thickness T between parallel first and second faces and transverse dimensions much greater than that. The exemplary cutting has the cut features of the RMC including the projections and the holes 58.

In a second step 204, if appropriate, the cutting is bent. More complex forming procedures are also possible.

The RMC may be coated 206 with a protective coating. Suitable coating materials include silica, alumina, zirconia, chromia, mullite and hafnia. Preferably, the coefficient of thermal expansion (CTE) of the refractory metal and the coating are similar. Coatings may be applied by any appropriate line-of sight or non-line-of sight technique (e.g., chemical or physical vapor deposition (CVD, PVD) methods, plasma spray methods, electrophoresis, and sol gel methods). Individual layers may typically be 0.1 to 1 mil (2.5 to 25 micrometers) thick. Layers of Pt, other noble metals, Cr, Si, W, and/or Al, or other non-metallic materials may be applied to the metallic core elements for oxidation protection in combination with a ceramic coating for protection from molten metal erosion and dissolution.

The RMC may then be mated/assembled 208 to the feedcore. For example, the feedcore may be pre-molded 210 and, optionally, pre-fired. The slot or other mating feature may be formed during that molding or subsequent cut. The RMC leading region may be inserted into the feedcore slot. Optionally, a ceramic adhesive or other securing means may be used. An exemplary ceramic adhesive is a colloid which may be dried by a microwave process. Alternatively, the feedcore may be overmolded to the RMC. For example, the RMC may be placed in a die and the feedcore (e.g., silica-, zircon-, or alumina-based) molded thereover. An exemplary overmolding is a freeze casting process. Although a conventional molding of a green ceramic followed by a de-bind/fire process may be used, the freeze casting process may have advantages regarding limiting degradation of the RMC and limiting ceramic core shrinkage.

FIG. 8 also shows an exemplary method 220 for investment casting using the composite core assembly. Other methods are possible, including a variety of prior art methods and yet-developed methods. The core assembly is then overmolded 230 with an easily sacrificed material such as a natural or synthetic wax (e.g., via placing the assembly in a mold and molding the wax around it). There may be multiple such assemblies involved in a given mold.

The overmolded core assembly (or group of assemblies) forms a casting pattern with an exterior shape largely corresponding to the exterior shape of the part to be cast. The pattern may then be assembled 232 to a shelling fixture (e.g., via wax welding between end plates of the fixture). The pattern may then be shelled 234 (e.g., via one or more stages of slurry dipping, slurry spraying, or the like). After the shell is built up, it may be dried 236. The drying provides the shell with at least sufficient strength or other physical integrity properties to permit subsequent processing. For example, the shell containing the invested core assembly may be disassembled 238 fully or partially from the shelling fixture and then transferred 240 to a dewaxer (e.g., a steam autoclave). In the dewaxer, a steam dewax process 242 removes a major portion of the wax leaving the core assembly secured within the shell. The shell and core assembly will largely form the ultimate mold. However, the dewax process typically leaves a wax or byproduct hydrocarbon residue on the shell interior and core assembly.

After the dewax, the shell is transferred 244 to a furnace (e.g., containing air or other oxidizing atmosphere) in which it is heated 246 to strengthen the shell and remove any remaining wax residue (e.g., by vaporization) and/or converting hydrocarbon residue to carbon. Oxygen in the atmosphere reacts with the carbon to form carbon dioxide. Removal of the carbon is advantageous to reduce or eliminate the formation of detrimental carbides in the metal casting. Removing carbon offers the additional advantage of reducing the potential for clogging the vacuum pumps used in subsequent stages of operation.

The mold may be removed from the atmospheric furnace, allowed to cool, and inspected 248. The mold may be seeded 250 by placing a metallic seed in the mold to establish the ultimate crystal structure of a directionally solidified (DS) casting or a single-crystal (SX) casting. Nevertheless the present teachings may be applied to other DS and SX casting techniques (e.g., wherein the shell geometry defines a grain selector) or to casting of other microstructures. The mold may be transferred 252 to a casting furnace (e.g., placed atop a chill plate in the furnace). The casting furnace may be pumped down to vacuum 254 or charged with a non-oxidizing atmosphere (e.g., inert gas) to prevent oxidation of the casting alloy. The casting furnace is heated 256 to preheat the mold. This preheating serves two purposes: to further harden and strengthen the shell; and to preheat the shell for the introduction of molten alloy to prevent thermal shock and premature solidification of the alloy.

After preheating and while still under vacuum conditions, the molten alloy is poured 258 into the mold and the mold is allowed to cool to solidify 260 the alloy (e.g., after withdrawal from the furnace hot zone). After solidification, the vacuum may be broken 262 and the chilled mold removed 264 from the casting furnace. The shell may be removed in a deshelling process 266 (e.g., mechanical breaking of the shell).

The core assembly is removed in a decoring process 268 to leave a cast article (e.g., a metallic precursor of the ultimate part). The cast article may be machined 270, chemically and/or thermally treated 272 and coated 274 to form the ultimate part. Some or all of any machining or chemical or thermal treatment may be performed before the decoring.

One or more embodiments have been described. Nevertheless, it will be understood that various modifications may be made. For example, the principles may be implemented using modifications of various existing or yet-developed processes, apparatus, or resulting cast article structures (e.g., in a reengineering of a baseline cast article to modify cooling passageway configuration). In any such implementation, details of the baseline process, apparatus, or article may influence details of the particular implementation. Accordingly, other embodiments are within the scope of the following claims.

What is claimed is:

1. An investment casting core combination comprising:
- a metallic casting core having opposite first and second faces; and
- a ceramic feedcore in which a first region of the metallic casting core is embedded, wherein:
- the metallic casting core comprises a mating edge having:
  - a plurality of projections, the first region being along at least some of the projections; and
  - a plurality of recesses, spanning gaps between adjacent said projections; and the ceramic feedcore comprises:
  - a compartment subdivided into a plurality of subcompartments having a height between compartment faces on respective sides of the compartment respectively receiving the metallic casting core projections along said first and second faces; and
  - a plurality of subdividing portions between the subcompartments, wherein the subdividing portions have a depth being less than the compartment depth so that the subcompartments merge along an initial portion of the compartment depth and respectively received in the metallic casting core recesses.

2. The investment casting core combination of claim 1 wherein:
- there are at least four said projections and at least three said subdividing portions between the subcompartments.

3. The investment casting core combination of claim 2 wherein:
- the projections are essentially locally coplanar with a main body of the metallic casting core.

4. The investment casting core combination of claim 1 wherein:
- at least three of the recesses and said subdividing portions received in said at least three recesses have depth of at least 0.75mm.

5. The investment casting core combination of claim 4 wherein:
- said depth is 1.0-2.5 mm.

6. The investment casting core combination of claim 1 wherein:
- along a majority of a total depth, said plurality of subcompartments have spanwise length no greater than 10 mm.

7. The investment casting core combination of claim 1 wherein:
- the metallic casting core has a plurality of internal apertures.

8. The investment casting core combination of claim 1 wherein:
- the first and second faces are parallel.

9. The investment casting core combination of claim 8 wherein:
- a thickness between said first and second faces is 0.2-0.5 mm over a majority of an area of the metallic casting core.

10. The investment casting core combination of claim 1 wherein:
- at least three of the recesses and said subdividing portions received in said at least three recesses have a total depth of 300-1600% of a median thickness of the metallic casting core.

11. The investment casting core combination of claim 1 wherein:
- along a majority of a total depth, said plurality of subcompartments have a median spanwise length 50-800% of a median depth.

12. The investment casting core combination of claim 1 wherein:
- a thickness of the feedcore at the subcompartments is 300-700% of a height at the subcompartments along at least a portion of the subcompartments.

13. An investment casting pattern comprising:
- the investment casting core combination of claim 1; and
- a wax material at least partially encapsulating the metallic casting core and the feedcore and having:
- an airfoil contour surface including:
  - a leading edge portion;
  - a trailing edge portion; and
  - pressure and suction side portions extending from the leading edge portion
- to the trailing edge portion, the metallic casting core protruding from the wax material proximate the trailing edge portion.

14. An investment casting shell comprising:
- the investment casting core combination of claim 1; and
- a ceramic stucco at least partially encapsulating the metallic casting core and the feedcore; and
- an airfoil contour interior surface including:
  - a leading edge portion;
  - a trailing edge portion; and
  - pressure and suction side portions extending from the leading edge portion and formed by the ceramic stucco, the metallic casting core protruding into the stucco proximate the trailing edge portion.

15. A method for forming the investment casting core combination of claim 1 comprising:
- forming the metallic casting core from sheetstock;
- molding the ceramic feedcore; and
- assembling the metallic core to the ceramic feedcore.

16. The method of claim 15 wherein:

the assembling comprises mounting an edge portion of the metallic casting core in a slot of the ceramic feedcore.

17. The method of claim 15 further comprising:

molding a pattern-forming material at least partially over the core assembly for forming a pattern;

shelling the pattern;

removing the pattern-forming material from the shelled pattern for forming a shell;

introducing molten alloy to the shell; and removing the shell and core assembly.

18. The method of claim 17 used to form a gas turbine engine component.

19. The investment casting core combination of claim 1 wherein:

said initial portion has a depth that is less than 50% of an average value of said compartment depth.

20. The investment casting core combination of claim 1 wherein:

said initial portion has a depth that is 5-20% of an average value of said compartment depth.

21. The investment casting core combination of claim 1 further comprising:

a ceramic adhesive between the metallic casting core and the ceramic feedcore.

* * * * *